US012232627B2

(12) United States Patent
Teller

(10) Patent No.: US 12,232,627 B2
(45) Date of Patent: Feb. 25, 2025

(54) APPARATUS FOR CONVERTIBLE AND SELECTABLE MATTRESS FIRMNESS

(71) Applicant: EMENDEEZ LLC, Wilmington, DE (US)

(72) Inventor: Adam Teller, Monsey, NY (US)

(73) Assignee: EMENDEEZ LLC, Wilmington, DE (US)

( * ) Notice: Subject to any disclaimer, the term of this patent is extended or adjusted under 35 U.S.C. 154(b) by 18 days.

(21) Appl. No.: 17/460,255

(22) Filed: Aug. 29, 2021

(65) Prior Publication Data

US 2023/0067095 A1 Mar. 2, 2023

(51) Int. Cl.

| | |
|---|---|
| ***A47C 27/14*** | (2006.01) |
| ***A47C 27/06*** | (2006.01) |
| ***A47C 27/15*** | (2006.01) |

(52) U.S. Cl.

CPC ..... *A47C 27/148* (2013.01); *A47C 27/064* (2013.01); *A47C 27/144* (2013.01); *A47C 27/15* (2013.01)

(58) Field of Classification Search

CPC ..... A47C 27/148; A47C 27/144; A47C 27/15; A47C 27/064; A47C 27/146; A47G 9/0238; A47G 9/0246; A47G 9/0261

See application file for complete search history.

(56) References Cited

U.S. PATENT DOCUMENTS 2,501,267 A * 3/1950 Erikson ..... A47G 9/0238 5/499
2,651,788 A * 9/1953 Forwood ..... A47C 27/15 5/1
5,555,581 A * 9/1996 Woods ..... A47C 19/028 5/513
5,701,620 A * 12/1997 Montross ..... A47C 27/001 5/661
5,970,547 A * 10/1999 Cavazos ..... A47C 31/105 5/722
2006/0272098 A1* 12/2006 Hochschild ..... A47C 27/144 5/738
2009/0100606 A1* 4/2009 An ..... A47C 27/15 5/690
2012/0144596 A1* 6/2012 Handson ..... A47C 27/15 5/690
2014/0208517 A1* 7/2014 Gross ..... A47C 27/15 5/691

(Continued)

*Primary Examiner* — Justin C Mikowski
*Assistant Examiner* — Alison N Labarge
(74) *Attorney, Agent, or Firm* — Bochner PLLC; Andrew Bochner; Eric Kleinertz

(57) ABSTRACT

Provided for is a mattress comprising a first layer comprising a first firm layer and a first soft layer, a second layer comprising a second firm layer and a second soft layer, where the second layer and the first layer are in horizontal adjacent contact. The mattress may further comprise a base layer comprising a base top layer and a base bottom layer, where the base layer and the first layer are in vertical adjacent contact, and where the base layer and the second layer are in vertical adjacent contact. The mattress may further comprise a cover comprising a cover top, a cover bottom, and a zipper, where the zipper may separate the cover top from the cover bottom, where a band may be disposed on an inside surface of the cover top, where the band may mask a gap between the first layer and the second layer.

18 Claims, 4 Drawing Sheets

(56) References Cited

U.S. PATENT DOCUMENTS

| | | | | |
|---|---|---|---|---|
| 2015/0074911 | A1* | 3/2015 | Dungan | A47G 9/1036 5/636 |
| 2015/0351557 | A1* | 12/2015 | Allen | A47C 27/085 5/652 |
| 2017/0119168 | A1* | 5/2017 | Al-Hazeem | A47C 27/062 |
| 2017/0224126 | A1* | 8/2017 | O'Connell, Jr. | A47G 9/10 |
| 2020/0397149 | A1* | 12/2020 | Magri | A47C 27/001 |
| 2021/0212481 | A1* | 7/2021 | Anderson | A47G 9/0238 |
| 2021/0235884 | A1* | 8/2021 | Nolte | A47C 27/148 |
| 2021/0274944 | A1* | 9/2021 | Chen | A47C 27/067 |
| 2022/0167753 | A1* | 6/2022 | Rasmussen | A47C 27/05 |

* cited by examiner

APPARATUS FOR CONVERTIBLE AND SELECTABLE MATTRESS FIRMNESS

FIELD OF THE DISCLOSURE

The present disclosure is generally related to mattresses and, more particularly, to mattresses with variable firmness.

Introduction

Sleep is a vital component of an individual's health. Proper sleep allows an individual's body to repair, replenish, and be ready for the next day. Inadequate sleep may lead to increased stress, decreased productivity, and a number of health issues. Thus, it is imperative that individuals experience meaningful uninterrupted sleep.

Often, a consumer must account for a number of variables when deciding on purchasing a mattress. Considering the fact that a mattress is one of the most important elements of a bedroom, it is a significant decision.

Mattress firmness is one of the key characteristics that a consumer may consider when selecting a mattress for purchase. In order to ensure an effective nights sleep; one must determine the right level of mattress firmness. If a consumer selects a mattress that is too soft or too firm, the consumer is unlikely to experience meaningful sleep. Accordingly, an individual with an unsuitable mattress may experience back and neck pain.

There are a number of mattresses available on the market, each with a fixed firmness. However, an issue is that two people often occupy one bed. Thus, while one partner may prefer a soft mattress the other partner may prefer a firm mattress. In fact, a number of studies claim that the majority of couples have incompatible firmness preferences (for example, 9 out of 10 couples may prefer contradicting firmnesses). Moreover, frequently an individual's firmness preference may change or an injury may warrant the individual to opt for a firmer or softer mattress. Thus, individuals with traditional fixed firmness mattresses must either purchase an entirely new mattress or risk nights of poor sleep.

While there are a number of expensive mattresses that offer the option to select a precise firmness, these are cost prohibitive to the majority of consumers (for example, roughly 90% of options in the overall mattress market may be between $2,500 and $5,000). Additionally, such variable firmness mattresses rarely address the problem of two individuals sharing the bed, especially when each individual has a different firmness preference. Therefore, when choosing a memory foam mattress, a cost-conscious consumer does not have an available option for a dual setting variable firmness mattress.

Therefore, there is a need for an improved mattress that could overcome the aforementioned issues. It would further be desirable to have an improved mattress that allows one or more individuals to variably select the firmness of a mattress, to each party's firmness preference, without compromising on comfort.

BRIEF DESCRIPTION OF THE DRAWINGS

The accompanying drawings illustrate various embodiments of systems, methods, and embodiments of various other aspects of the disclosure. Any person with ordinary skills in the art will appreciate that the illustrated element boundaries (e.g. boxes, groups of boxes, or other shapes) in the figures represent one example of the boundaries. It may be that in some examples one element may be designed as multiple elements or that multiple elements may be designed as one element. In some examples, an element shown as an internal component of one element may be implemented as an external component in another, and vice versa. Furthermore, elements may not be drawn to scale. Non-limiting and non-exhaustive descriptions are described with reference to the following drawings. The components in the figures are not necessarily to scale, emphasis instead being placed upon illustrating principles.

DETAILED DESCRIPTION

Embodiments of the present disclosure will be described more fully hereinafter with reference to the accompanying drawings in which like numerals represent like elements throughout the several figures, and in which example embodiments are shown. Embodiments of the claims may, however, be embodied in many different forms and should not be construed as limited to the embodiments set forth herein. The examples set forth herein are non-limiting examples and are merely examples among other possible examples. For the purposes of this disclosure, the invention of the presentation disclosure may be configured for use with a bed, a mattress, a daybed, a sofa, or any other seating apparatus.

Figure 1:
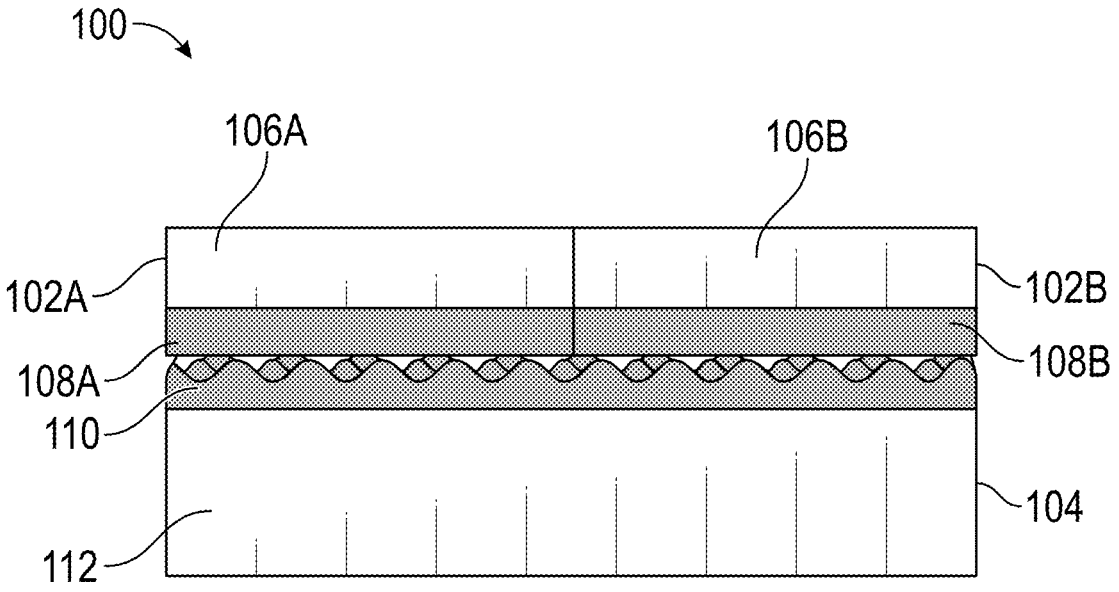
FIG. 1 is an illustration of a cross-sectional front view of an embodiment of the mattress.

Referring to FIG. 1, in an embodiment, the invention of the present disclosure is a mattress 100 comprising a plurality of layers. The mattress 100 may include a first layer 102A, a second layer 102B, and a base layer 104. The first layer 102A and the second layer 102B may be disposed above the base layer 104. The first layer 102A may include a first firm layer 106A and a first soft layer 108A. The second layer 102B may include a second firm layer 106B and a second soft layer 108B. The base layer 104 may include a base top layer 110 and a base bottom layer 112.

In an embodiment, the first firm layer 106A may be firmer than the first soft layer 108A. Similarly, in an embodiment, the second firm layer 106B may be firmer than the second soft layer 108B. In an embodiment, the first firm layer 106A and the second firm layer 106B may be equivalent firmness. In an embodiment, the first soft layer 108A and the second soft layer 108B may have equivalent firmness. However, in various embodiments, the layers 106A/106B/108A/108B may have any firmness. In an embodiment, the firm layers 106A/106B, the soft layers 108A/108B, and the base layers 110/112 may be composed of memory foam. In an embodiment, the memory foam may be infused with cooling gel and/or graphite. In an embodiment, the first layer 102A, the second layer 102B, and/or the base layer 104 may have an open-cell structure (for example, giving the memory foam mattresses a very responsive, pressure relieving, and comfortable feel). The open-cell structure may be instituted in the base layer 104, which may serve as a foundation to the mattress 100 and may provide consistent support to each of the two people sleeping on their respective side of the mattress 100, regardless if they flip the first layer 102A or second layer 102B to the firm side or soft side. In such an embodiment, the open-cell structure is composed of dense memory foam conducive to even support.

In an embodiment, the base top layer 110 may be softer than the base bottom layer 112. However, in another embodiment, the base top layer 110 may be firmer than the base bottom layer 112. In an embodiment, the base top layer 110 is an egg crate layer. In an alternate embodiment, the base top layer 110 may be any form of memory foam. The base top layer 110 may be a graphite infused egg crate layer. In an embodiment, the egg crate layer is configured to dissipate heat (for example, heat trapped between the first layer 102A, the second layer 102B, and the base layer 104). In an embodiment, the base layer 104 may be composed of a supportive foam. For example, the supportive foam may have sufficient structure to support the weight of the first layer 102A, the second layer 102B, and two or more adults.

In an embodiment, the first firm layer 106A and the first soft layer 108A are conjoined with an adhesive. In another embodiment, the first firm layer 106A and the first soft layer 108A are conjoined via sewing or another method of merger. In an embodiment, the first firm layer 106A and the first soft layer 108A are not conjoined. In such an embodiment, the first firm layer 106A may rest atop the first soft layer 108A. In an embodiment, the second firm layer 106B and the second soft layer 108B and the base top layer 110 and the base bottom layer 112 may also be conjoined (or not conjoined) in any of the aforementioned manners.

Figure 2:
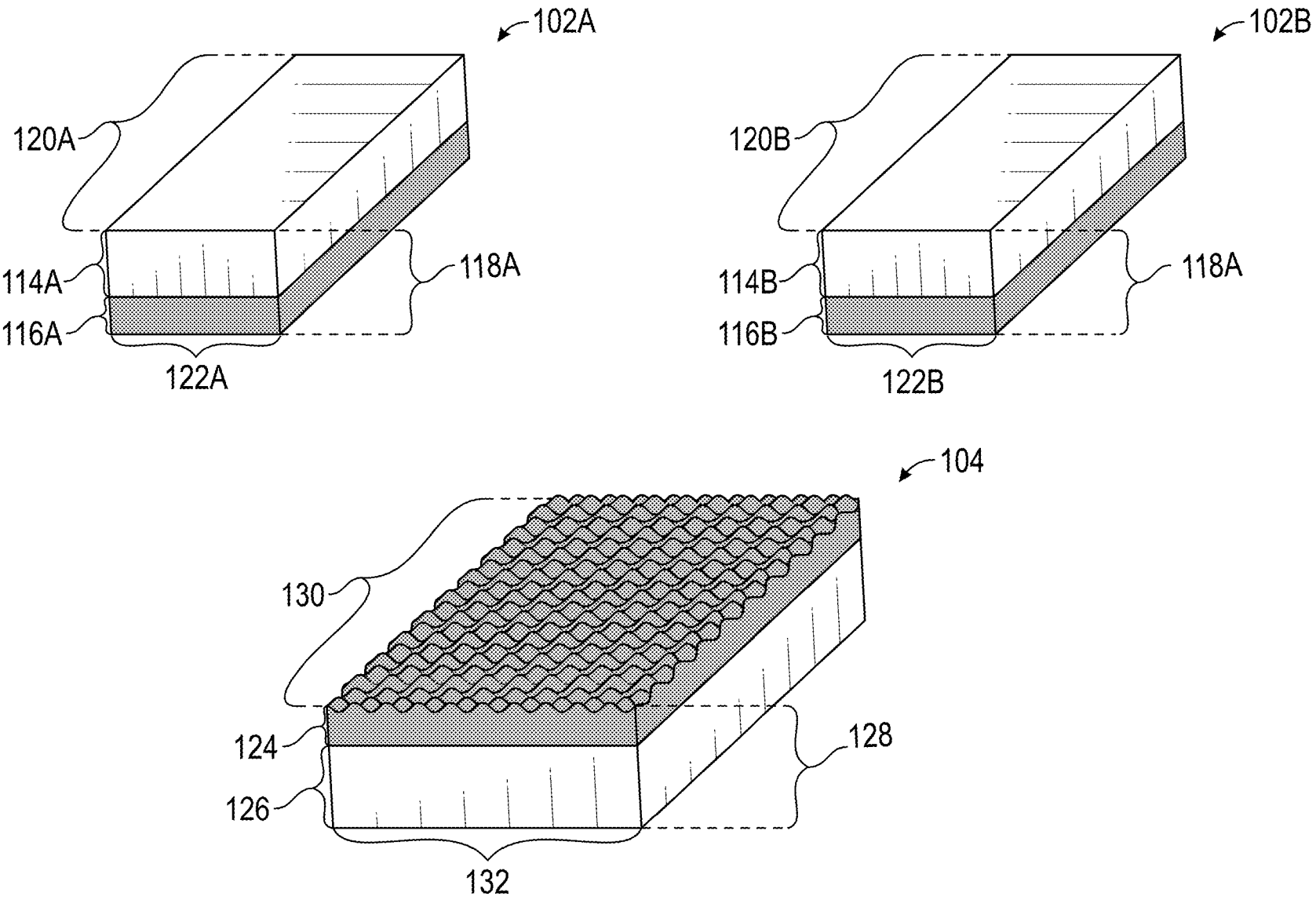
FIG. 2 is an exploded view of an embodiment of the mattress.

Referring to FIG. 2, in an embodiment, the first layer 102A includes a first firm layer height 114A, a first soft layer height 116A, a first layer height 118A, a first layer length 120A, and first layer width 122A. In an embodiment, the second layer 102B includes a second firm layer height 114B, a second soft layer height 116B, a second layer height 118B, a second layer length 120B, and second layer width 122B. In an embodiment, the base layer 104 includes a base top layer height 124, a base bottom layer height 126, a base layer height 128, a base layer length 130, and a base layer width 132.

In an embodiment, the sum of the first firm layer height 114A and the first soft layer height 116A is the first layer height 118A. In an embodiment, the sum of the second firm layer height 114B and the second soft layer height 116B is the second layer height 118B. In an embodiment, the sum of the base top layer height 124 and base bottom layer height 126 is the base layer height 128. In an embodiment, the first firm layer height 114A is greater than the first soft layer height 116A. However, in an alternate embodiment, the first firm layer height 114A is less than the first soft layer height 116A. In an embodiment, the second firm layer height 114B is greater than the second soft layer height 116B. However, in an alternate embodiment, the second firm layer height 114B is less than the second soft layer height 116B. In an embodiment, the base bottom layer height 126 is greater than the base top layer height 124. However, in an alternate embodiment, the base bottom layer height 126 is less than the base top layer height 124.

In an embodiment, the first firm layer height 114A, the first soft layer height 116A, the first layer height 118A, the first layer length 120A, and the first layer width 122A are equivalent to the second firm layer height 114B, the second soft layer height 116B, the second layer height 118B, the second layer length 120B, and the second layer width 122B, respectively (for example, the first layer 102A and second layer 102B are isometric). However, in another embodiment, any of the dimensions of the first layer 102A may be different than any of the dimensions of the second layer 102B.

In an embodiment, a tag or other indicator may be disposed on the first layer 102A and/or the second layer 102B. The indicator may have a top side and a bottom side. The top side of the indicator may correlate to the firm sides 106A/106B and the bottom side of the indicator may correlate to the soft sides 108A/108B. As a non-limiting example, the indicator may be configured to inform a user as to whether the soft layer or the firm layer is facing up. In an alternate embodiment, the indicator may be tactile, for example, the indicator may inform the user as to the position of the layers by touch. In an embodiment, the one or more indicators may be sewn or otherwise fastened to the first layer 102A and/or second layer 102B (for example, along the seam separating the firm and soft layers). In an embodiment, the one or more indicators may be disposed on the first subcover 154A and/or the second subcover 154B.

Figure 3:
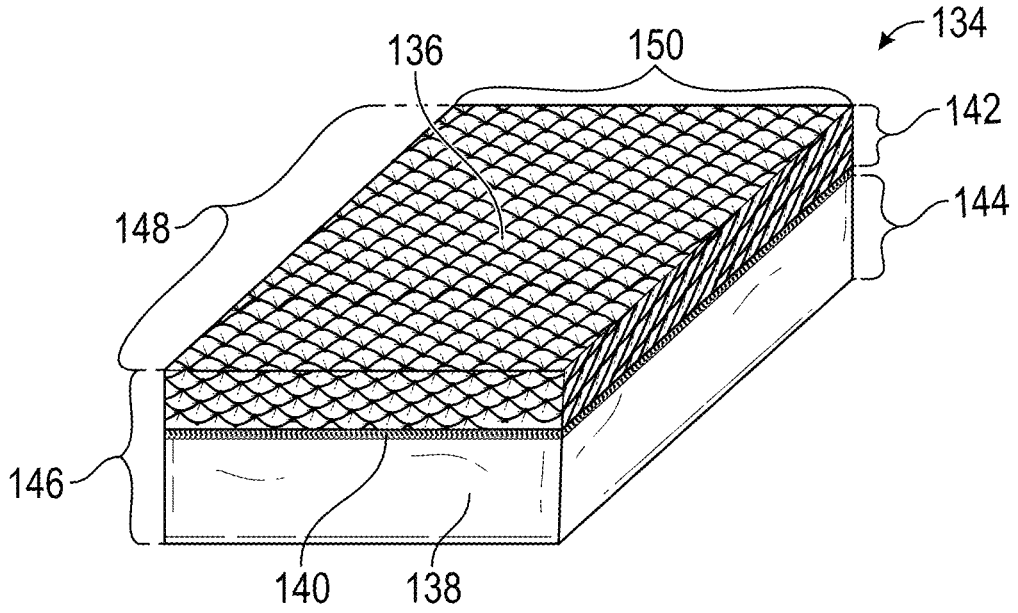
FIG. 3 is an illustration of an embodiment of the mattress having a cover.

Referring to FIG. 3, in an embodiment, the mattress 100 includes a cover 134. The cover 134 may include a cover top 136 and a cover bottom 138. The cover 134 may further comprise a zipper 140. The cover 134 may have a cover top height 142, a cover bottom height 144, a cover height 146, a cover length 148, and a cover width 150.

In an embodiment, the cover top 136 is composed of a plush material (for example, an ultra soft plush bamboo). In an embodiment, the cover top 136 has an inner surface and an outer surface, where the outer surface may be plush, while the inner surface may be coarse. In an embodiment, the top cover 136 is composed of a cool flow micro vented, woven, or knit material. However, the cover top 136 may be composed of any suitable material.

In an embodiment, the cover bottom 138 is composed of brushed micro suede. The cover bottom 138 may include an anti-slip material (for example, disposed on the bottom surface of the cover bottom 138). In an embodiment, the cover bottom 138 has an inner surface and an outer surface, where the outer surface may be micro suede, while the inner surface may be coarse. However, the cover bottom 138 may be composed of any suitable material.

In an embodiment, a zipper 140 surrounds the cover 134 along a seam formed by the meeting of the cover top 136 and the cover bottom 138. The zipper 140 may enable the cover top 136 to completely separate from the cover bottom 138. However, in another embodiment, the zipper 140 may enable partial separation of the cover top 136 and the cover bottom 138. In an embodiment, the zipper 140 may include reverse tracks (for example, facing towards the layers). For example, the zipper teeth may be reversed, such that they are not readily apparent to a spectator. In an embodiment, the zipper 140 may begin roughly three quarters of the way back, on the left side, of the cover 134. In an embodiment where the zipper 140 enables complete separation of the cover top 136 and the cover bottom 138, the zipper 140 starts and ends at the same position. In an embodiment where the zipper 140 enables partial separation of the cover top 136 and the cover bottom 138, the zipper 140 has a start point and an end point.

In an embodiment, the cover 134 is configured to encapsulate at least the first layer 102A, the second layer 102B, and the base layer 104. In an embodiment, the cover top 136 may partially encapsulate the first layer 102A and the second layer 102B (for example, the cover top 136 may interface with the top surfaces and the side surfaces of the first layer 102A and the second layer 102B). In an embodiment, the cover bottom 138 may partially encapsulate the base layer 104 (for example, the cover bottom 138 may interface with the bottom surface and side surfaces of the base layer 104).

In an embodiment, the cover width 150 is equivalent to the sum of the first layer width 122A and the second layer width 122B. In an embodiment, the cover top height 142 is equivalent to the first layer height 118A and/or the second layer height 118B. In an embodiment, the cover bottom height 144 is equivalent to the base layer height 130.

In an embodiment, the cover 134 is sized such that when the cover top 136 and the cover bottom 138 are joined and when the cover 134 encapsulates the first layer 102A, the second layer 102B, and the base layer 104, the cover 134 imposes an inward force on each of the aforementioned three layers. In an embodiment, the inward force is sufficient to hold the three layers 102A/102B/104 in a rectangular prism shape. For example, the cover 134 imposes enough inward force such that, from an outside perspective, the mattress 100 visually appears to have a singular internal component. Thus, in such an embodiment, the first layer 102A, second layer 102B, and the base layer 104, may function as mattress components without being tethered to one another. Such an embodiment may permit a user to alter the positions or orientations of the layers, while still maintaining a sufficient shape and structure. In an embodiment, the cover 134 is sized and configured to maintain the first layer 102A, the second layer 102B, and the base layer 104 as a continuous rectangular prism.

Figure 4:
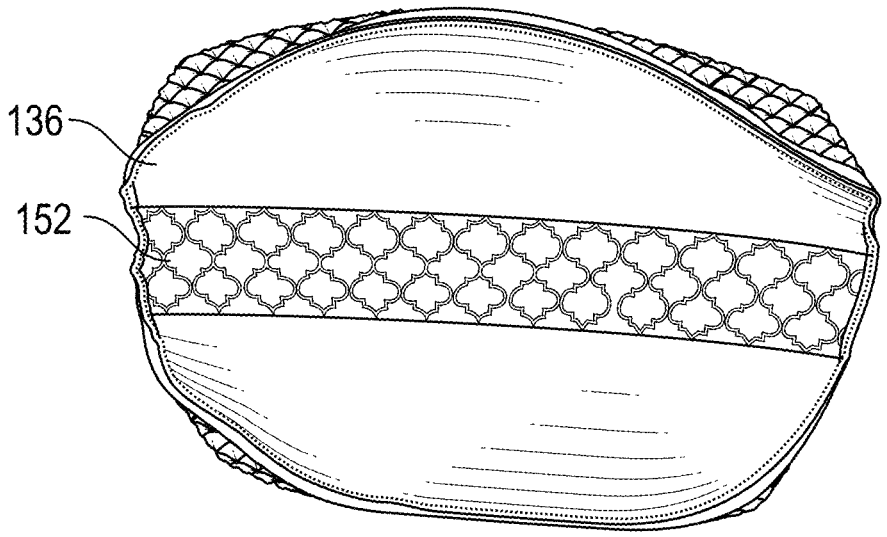
FIG. 4 is an illustration of an embodiment of the inside surface of the cover top.

Referring to FIG. 4, in an embodiment, the cover top 136 has a band 152. The band 152 may traverse the inside surface of the cover top 136. The band 152 may be a ribbon of a material (for example, a fabric), configured to rest between the inside surface of the cover top 136 and at least partially the first layer 102A and the second layer 102B. As a non-limiting example, the band 152 may reduce a user's ability to discern the space between the first layer 102A and the second layer 102B. For example, the band 152 may alleviate the seam between the first layer 102A and the second layer 102B. In an embodiment, the band 152 traverses the center of the inside cover top 136 for the cover length 148. In an embodiment, the band 152 is sufficiently wide to prevent a user from noticing the gap between the first layer 102A and the second layer 102B when applying a downward force. In an embodiment, the band 152 is sufficiently thick, such that the gap between the first layer 102A and the second layer 102B is sufficiently unnoticeable by a user. The band 152 may have a distal end and a proximal end, where both ends are adhered to the cover top 136. As a non-limiting example, the band 152 may be sewn, or otherwise fastened, to the inside surface of the cover top 136 along the piece of material directly above the zipper 140. In such a non-limiting example, the band 152 covers the seam of the first layer 102A and the second layer 102B on front surface, the top surface, and the rear surface. In a further non-limiting example, the band 152 may be fastened to the inside surface of the cover top 136 at a plurality of points along the central lengthwise axis. In such a non-limiting example, the plurality of fastening points may prevent the band 152 from wrinkling, folding, or otherwise becoming misshapen while in use.

Figure 5:
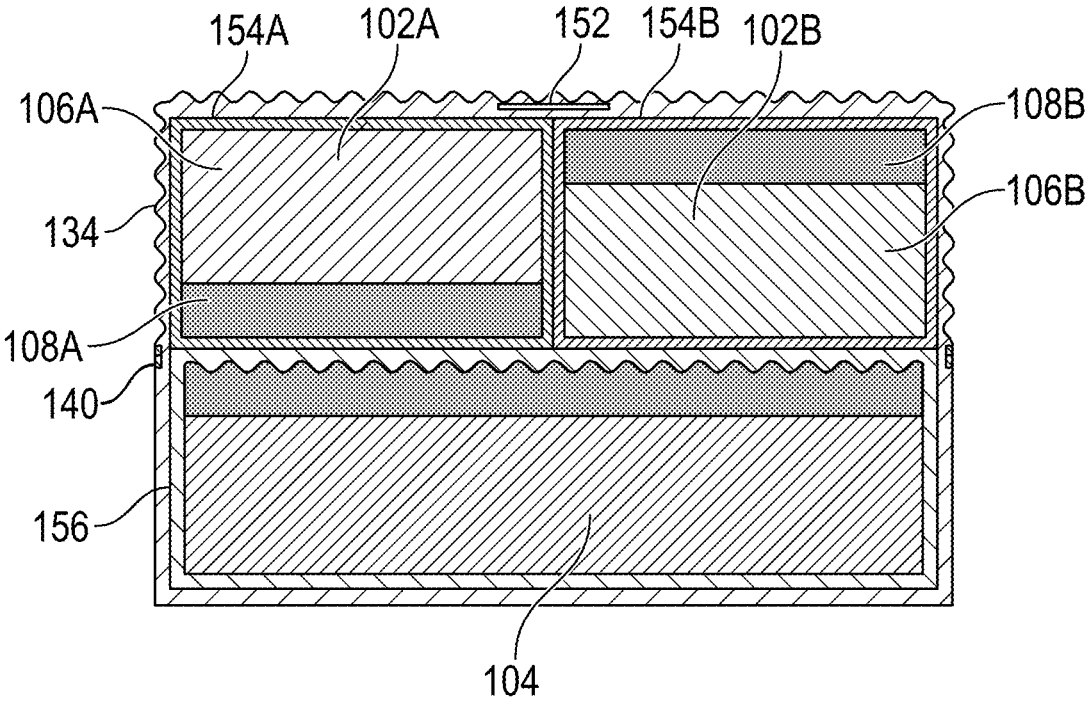
FIG. 5 is a cross-sectional front view of an embodiment of the mattress having a first layer, a second layer, a base layer, a cover, and one or more subcovers.

Referring to FIG. 5, in an embodiment, the first layer 102A is encapsulated by a first subcover 154A. The second layer 102B may be encapsulated by a second subcover 154B. The base layer 104 may be encapsulated by a base subcover 156. In an embodiment, the first subcover 154A, the second subcover 154B, and the base subcover 156 are composed of a fire retardant material. In an embodiment, the material of the subcovers 154A/154B/156 may be water-proof. In another embodiment, the material of the subcovers 154A/154B/156 may be insect-proof (for example, bed bugs). In an embodiment, the subcovers 154A/154B/156 are sufficiently thin, such that the layers may be encapsulated by the subcovers 154A/154B/156 and still be encapsulated by the cover 134. As a non-limiting example, there may be a negligible different between the dimensions of the layers 102A/102B/104 with subcovers 154A/154B/156 and dimensions of the layers 102A/102B/104 without subcovers 154A/154B/156, respectively. In an embodiment, any of the subcovers 154A/154B/156 may include one or more zippers and/or openings. In such an embodiment, the one or more zippers and/or openings may be configured such that a user may remove the layers 102A/102B/104 from the subcovers 154A/154B/156. The zippers and/or openings may be disposed on the subcovers 154A/154B/156 in manners similar to how the zipper 140 is disposed on the cover 134. In an alternate embodiment, the subcovers 154A/154B/156 are not removable.

In an embodiment, the firm sides of the layers 102A/102B are configured to provide optimal sleep experience for those who sleep on their back or stomach, or for heavier individuals. In an embodiment, the soft sides of the layers 102A/102B are configured to provide optimal sleep experience for those who sleep on their sides, back, or stomach, or for light-weight individuals.

Figure 6:
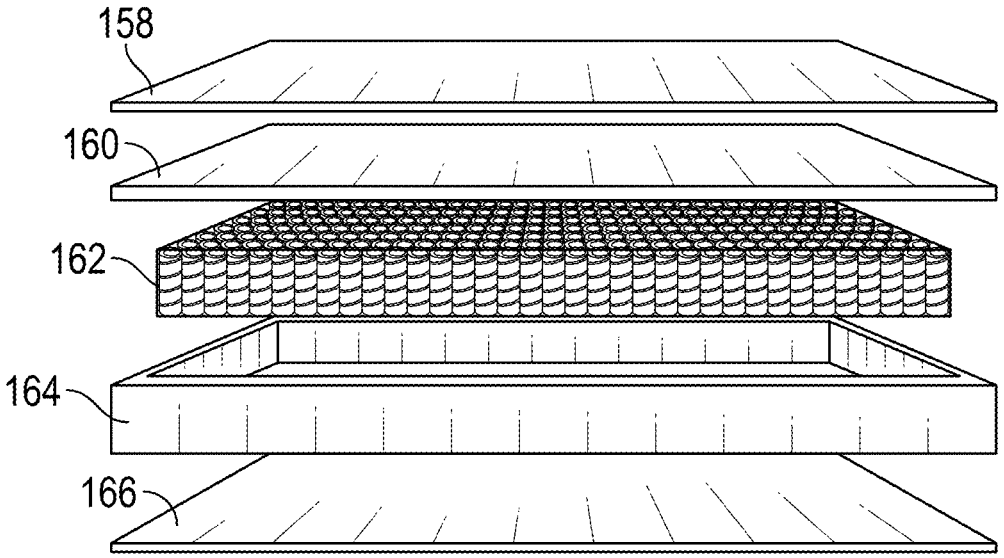
FIG. 6 is an exploded view of an embodiment of a layer having a spring component.

Referring to FIG. 6, any of the layers 102A/102B/104 may include a foam top 158, a first foam layer 160, a pocket spring 162, a fence 164, and/or a second foam layer 166. For the purposes of this disclosure, such an embodiment may be referred to herein as a hybrid layer. The foam top 158 may be disposed above the first foam layer 160. The foam top 158 may be adhered to the first foam layer 160. The pocket spring 162 may traverse the entirety of the inside of the fence 164. The pocket spring 162 may be a series of vertical springs disposed in sleeves. For example, the springs may sit vertically in cylindrical sleeves of fabric or foam. The pocket spring 162 and the fence 164 may be disposed atop the second foam layer 166. The fence 164 may be sized such that it conceals the pocket spring 162 and traverses the width and length of the second foam layer 166, the first foam layer 160, and the foam top 158. In an embodiment, such an embodiment may provide a higher level of precision in the contouring of the mattress to each individual part of the body (for example, if a user is sleeping on their side, it may press against each part according to the counter pressure applied to it). In such an embodiment, this combination of foam and springs may facilitate the advantages of coils with the key benefits of foam, including contouring, responsiveness, quilting and even surface infusions for cooling. In an embodiment, the use of the pocket spring 162 may reduce the transfer of motion, while also enhancing comfort and support. In an embodiment, the use of the pocket spring 162 may also increase airflow, enabling a cooler mattress.

In an embodiment, the hybrid layer (for example, the layer as shown in FIG. 6) may replace the base layer 104 (for example, as shown in FIG. 1). In such an embodiment, the base layer 104 may include a pocket spring 162 and the first layer 102A and the second layer 102B may be as depicted in FIG. 1. For example, the mattress 100 may include the first layer 102A, the second layer 102B, and a hybrid base layer. In an embodiment, the base layer 104 may comprise a foam top 158, a first foam layer 160, a pocket spring 162, a fence 164, and a second foam layer 166, the foam top 158 adhered to the first foam layer 160, the fence 164 partially encapsulating the pocket spring 162, the fence 164 configured to form a perimeter around the pocket spring 162, the foam top 158 and the first foam layer 160 disposed above the fence 164 and the pocket spring 162, the foam top 158 and the first foam layer 160 traversing the fence 164, the second foam layer 166 disposed below the fence 164, the second foam layer 166 traversing the fence 164. In an embodiment, the layer as shown in FIG. 6 may replace the first layer 102A and/or the second layer 102B as shown in FIG. 1. In another embodiment, the hybrid layer (for example, as shown in FIG. 6) may replace the first layer 102A, the second layer 102B, and the base layer 104. In another embodiment, the hybrid layer (for example, as shown in FIG. 6) may be disposed above the first layer 102A and the second layer 102B, where the first layer 102A and the second layer 102B are disposed above the base layer 104. In another embodiment, the hybrid layer (for example, as shown in FIG. 6) may be disposed above the base layer 104, but below the first layer 102A and the second layer 102B.

In an alternate embodiment, the mattress 100 may include only a first layer 102A and a base layer 104, where the first layer 102A traverses the entire top surface of the base layer 104. In another alternate embodiment, the first layer 102A, the second layer 102B, and/or the base layer 104 may include a single sublayer. For example, in an alternate embodiment, the first layer 102A may have a first firm layer 106A and a first soft layer 108A and the second layer 102B may only have a first soft layer 108B. In an alternate embodiment, the mattress 100 may include only a first layer 102A and a second layer 102B.

In an embodiment, the mattress 100 is configurable for variable firmness. In such an embodiment, the first layer 102A and the second layer 102B are positionally convertible. For example, a user may position: the first firm layer 106A and the second firm layer 106B facing up; the first firm layer 106A and the second soft layer 108B facing up; the first soft layer 108A and the second firm layer 106B facing up; or the first soft layer 108A and the second soft layer 108B facing up.

In an embodiment, the mattress 100 is configured such that a user may open the zipper 140, separate the cover top 136 from the cover bottom 138, and flip one or more of the layers 102A/102B to select the desired firmness setting. Further, the layers 102A/102B are sized, such that regardless of firmness selection, the mattress 100 holds its shape and structure and provides sufficient support to one or more users.

In an embodiment, any of the layers 102A/102B/104 may be rotated vertically and/or horizontally. For example, any of the layers 102A/102B/104 may be rotated 180 degrees about an axis extending lengthwise through the layer, such that a user may change the firmness. As another example, any of the layers 102A/102B/104 may be rotated 180 degrees about an axis extending widthwise, such that the same sublayer (firmness) is facing upward. In such an example, a user may choose to rotate any of the layers 102A/102B/104 about the axis extending widthwise to mitigate wear on the mattress 100.

In an embodiment, any of the components of the mattress 100 may be composed of any suitable material. A non-limiting list of suitable materials may include: breathable bamboo (for example, ultra-soft bamboo, creating a breathable layer); gel-infused memory foam (for example, cooling gel foam, producing a refreshing sleep); graphite foam (for example, dissipates heat for a cooler night); egg carton (for example, a structure maximizing air ventilation); base foam (for example, to experience durable support and consistent stability); zipper (for example, making mattress components easily removable and washable); micro-suede finish (for example, luxurious brushed microsuede, offering a premium finish); and anti-slip grip pad (for example, keeping the mattress secure on any base).

In a further embodiment, the mattress 100 may be configured to enable a user to easily remove layers 102A/102B/104 for service or washing. In another further embodiment, the mattress 100 may be supplemented with new versions of the layers 102A/102B/104. As a non-limiting example, a number of options for first layer 102A and second layer 102B may be available to a user (for example, ordered via the internet or purchased from a mattress store). In such a non-limiting example, supplementary layers or replacement layers may be provided with the same dimensions as first layer 102A and/or second layer 102B (for example, allowing a user to maintain a collection of layers of various densities).

In an embodiment, the invention of the present disclosure may be a mattress comprising a first layer comprising a first firm layer and a first soft layer, a second layer comprising a second firm layer and a second soft layer, where the second layer and the first layer are in horizontal adjacent contact, and where the first firm layer is firmer than the first soft layer and the second firm layer is firmer than the second soft layer. The mattress may further comprise a base layer comprising a base top layer and a base bottom layer, where the base layer and the first layer are in vertical adjacent contact, and where the base layer and the second layer are in vertical adjacent contact. In an embodiment, the mattress may further comprise a cover comprising a cover top, a cover bottom, and a zipper, where the zipper is configured to separate the cover top from the cover bottom, where the cover top is sized to accept the first layer and the second layer, and where the cover bottom is sized to accept the base layer; and a band disposed on an inside surface of the cover top, the band at least traversing a cover length, where the band is configured to mask a gap between the first layer and the second layer.

In an embodiment, the first firm layer and second firm layer are of equal firmness and/or the first soft layer and the second soft layer are of equal firmness. In an embodiment, the base top layer may be egg crate shaped. In an embodiment, the first layer may further comprise a first firm layer height, a first soft layer height, a first layer height, a first layer length, and a first layer width, the second layer may further comprise a second firm layer height, a second soft layer height, a second layer height, a second layer length, and a second layer width, the cover top may comprise a cover top height, a cover length, and a cover width, where the first layer height and the second layer height are equivalent to the cover height, and where the cover width is equivalent to a sum of the first layer width and the second layer width. In an embodiment, the cover top is a plush top.

In an embodiment, the mattress may further comprise a first subcover, a second subcover, and a base subcover, where the first subcover encapsulates the first layer, the second subcover encapsulates the second layer, and the base subcover encapsulates the base layer. In an embodiment, the first subcover, the second subcover, and the base subcover are flame retardant. In an embodiment, the base layer may comprise a base layer height, a base layer width, and a base layer length, the cover bottom may further comprise a cover bottom height, the cover length, and the cover width, where the base layer height and the cover bottom height are equivalent.

In an embodiment, the first layer and the second layer may be positionally convertible; where the mattress comprises four modes; a first mode where the first firm layer and the second firm layer are facing up; a second mode where the first firm layer and the second soft layer are facing up; a third mode where the first soft layer and the second firm layer are facing up; and a fourth mode where the first soft layer and the second soft layer are facing up.

While this invention has been described in conjunction with the embodiments outlined above, many alternatives, modifications and variations will be apparent to those skilled in the art upon reading the foregoing disclosure. Accordingly, the embodiments of the invention, as set forth above, are intended to be illustrative, not limiting. Various changes may be made without departing from the spirit and scope of the invention.

What is claimed is:

1. A mattress comprising:

a first layer comprising a first firm layer and a first soft layer, wherein a top surface of the first soft layer is flat;

a second layer comprising a second firm layer and a second soft layer, wherein a top surface of the second soft layer is flat, wherein the second layer and the first layer are in horizontal adjacent contact, and wherein the first firm layer is firmer than the first soft layer and the second firm layer is firmer than the second soft layer;

a base layer comprising a base top layer and a base bottom layer, wherein the base top layer is egg crate shaped, wherein the base layer and the first layer are in vertical adjacent contact, and wherein the base layer and the second layer are in vertical adjacent contact; and a cover comprising a cover top, a cover bottom, and a zipper, wherein the zipper is configured to completely separate the cover top from the cover bottom, wherein the cover top is sized to accept the first layer and the second layer, and wherein the cover bottom is sized to accept the base layer; and at least one tactile indicator disposed on at least one of the first layer, or second layer, the at least one tactile indicator including:

an indicator topside disposed upon at least one of the first or second firm layers; and an indicator bottom side disposed on at least one of the first or second soft layers, wherein the at least one tactile indicator is configured to inform a user of an orientation of the first or second layer via touch.

2. The mattress of claim 1, wherein the first firm layer and the second firm layer are of equal firmness.

3. The mattress of claim 1, wherein the first soft layer and the second soft layer are of equal firmness.

4. The mattress of claim 1, the first layer further comprising a first firm layer height, a first soft layer height, a first layer height, a first layer length, and a first layer width, the second layer further comprising a second firm layer height, a second soft layer height, a second layer height, a second layer length, and a second layer width, the cover top comprising a cover top height, the cover length, and a cover width, wherein the first layer height and the second layer height are equivalent to the cover height, and wherein the cover width is equivalent to a sum of the first layer width and the second layer width.

5. The mattress of claim 4, the base layer further comprising a base layer height, a base layer width, and a base layer length, the cover bottom further comprising a cover bottom height, the cover length, and the cover width, wherein the base layer height and the cover bottom height are equivalent.

6. The mattress of claim 1, further comprising a first subcover, a second subcover, and a base subcover, wherein the first subcover encapsulates the first layer, the second subcover encapsulates the second layer, and the base subcover encapsulates the base layer.

7. The mattress of claim 6, wherein the first subcover, the second subcover, and the base subcover are flame retardant.

8. The mattress of claim 1, wherein the first layer and the second layer are positionally convertible; wherein the mattress comprises four modes; a first mode wherein the first firm layer and the second firm layer are facing up; a second mode wherein the first firm layer and the second soft layer are facing up; a third mode wherein the first soft layer and the second firm layer are facing up; and a fourth mode wherein the first soft layer and the second soft layer are facing up.

9. The mattress of claim 1, wherein an outer surface of the cover top is plush, and an inner surface of the cover top is coarse.

10. A mattress comprising:

a first layer comprising a first firm layer and a first soft layer, wherein a top surface of the first soft layer is flat;

a second layer comprising a second firm layer and a second soft layer, wherein a top surface of the second soft layer is flat, wherein the second layer and the first layer are in horizontal adjacent contact, and wherein the first firm layer is firmer than the first soft layer and the second firm layer is firmer than the second soft layer;

a base layer comprising a foam top, a first foam layer, a pocket spring, a fence, and a second foam layer, the foam top adhered to the first foam layer, the fence partially encapsulating the pocket spring, the fence configured to form a perimeter around the pocket spring, the foam top and the first foam layer disposed above the fence and the pocket spring, the foam top and the first foam layer traversing the fence, the second foam layer disposed below the fence, the second foam layer traversing the fence, wherein the foam top is egg crate shaped, wherein the base layer and the first layer are in vertical adjacent contact, and wherein the base layer and the second layer are in vertical adjacent contact;

a cover comprising a cover top, a cover bottom, and a zipper, wherein the zipper is configured to completely separate the cover top from the cover bottom, wherein the cover top is sized to accept the first layer and the second layer, and wherein the cover bottom is sized to accept the base layer; and a band attached to an inside surface of the cover top, the band at least traversing a cover length, wherein the band is a flat planar member, and wherein the band is configured to mask the horizontal adjacent contact between the second layer and first layer; and at least one tactile indicator disposed on at least one of the first layer, or second layer, the at least one tactile indicator including:

an indicator topside disposed upon at least one of the first or second firm layers; and an indicator bottom side disposed on at least one of the first or second soft layers, wherein the at least one tactile indicator is configured to inform a user of an orientation of the first or second layer via touch.

11. The mattress of claim 10, wherein the first firm layer and the second firm layer are of equal firmness.

12. The mattress of claim 10, wherein the first soft layer and the second soft layer are of equal firmness.

13. The mattress of claim 10, the first layer further comprising a first firm layer height, a first soft layer height, a first layer height, a first layer length, and a first layer width, the second layer further comprising a second firm layer height, a second soft layer height, a second layer height, a second layer length, and a second layer width, the cover top comprising a cover top height, the cover length, and a cover width, wherein the first layer height and the second layer height are equivalent to the cover height, and wherein the cover width is equivalent to a sum of the first layer width and the second layer width.

14. The mattress of claim 13, the base layer further comprising a base layer height, a base layer width, and a base layer length, the cover bottom further comprising a cover bottom height, the cover length, and the cover width, wherein the base layer height and the cover bottom height are equivalent.

15. The mattress of claim 10, further comprising a first subcover, a second subcover, and a base subcover, wherein the first subcover encapsulates the first layer, the second subcover encapsulates the second layer, and the base subcover encapsulates the base layer.

16. The mattress of claim 15, wherein the first subcover, the second subcover, and the base subcover are flame retardant.

17. A mattress comprising:

a first layer comprising a first firm layer and a first soft layer, wherein a top surface of the first soft layer is flat;

a second layer comprising a second firm layer and a second soft layer, wherein a top surface of the second soft layer is flat, wherein the second layer and the first layer are in horizontal adjacent contact, and wherein the first firm layer is firmer than the first soft layer and the second firm layer is firmer than the second soft layer;

a base layer comprising a base top layer and a base bottom layer, wherein the base top layer is egg crate shaped, wherein the base layer and the first layer are in vertical adjacent contact, and wherein the base layer and the second layer are in vertical adjacent contact; and a cover comprising a cover top, a cover bottom, and a zipper, wherein the zipper is configured to completely separate the cover top from the cover bottom, wherein the cover top is sized to accept the first layer and the second layer, and wherein the cover bottom is sized to accept the base layer; and at least one tactile indicator disposed on at least one of the first layer, or second layer, the at least one tactile indicator including:

an indicator topside disposed upon at least one of the first or second firm layers; and an indicator bottom side disposed on at least one of the first or second soft layers, wherein the at least one tactile indicator is configured to inform a user of an orientation of the first or second layer via touch.

18. The mattress of claim 17, wherein the egg crate layer is infused with graphite.

* * * * *